United States Patent [19]

Mironenko et al.

[11] Patent Number: 4,629,838

[45] Date of Patent: Dec. 16, 1986

[54] SENSITIVE CONSTANT CONTACT PRESSURE MICROSWITCH

[75] Inventors: Vyacheslav G. Mironenko, Moscow; Alexandr P. Poltorak, Donetsk; Vitaly I. Schutsky, Moscow; Vladimir A. Kosovtsev, Kharkov; Fedor P. Chaly, Kharkov; Vladislav F. Zagubeljuk, Kharkov; Nikolai I. Filatov, Kizlyar, all of U.S.S.R.

[73] Assignee: Tekhnologichesky Institut Vzryvozashischennogo I Rudnichnogo Elektrooborudovania, Donetsk, U.S.S.R.

[21] Appl. No.: 541,334

[22] PCT Filed: Feb. 9, 1982

[86] PCT No.: PCT/SU82/00006

§ 371 Date: Sep. 19, 1983

§ 102(e) Date: Sep. 19, 1983

[87] PCT Pub. No.: WO83/02848

PCT Pub. Date: Aug. 18, 1983

[51] Int. Cl.[4] ..... H01H 21/42

[52] U.S. Cl. ..... 200/67 D

[58] Field of Search ..... 200/67 D, 67 DA, 67 DB

[56] References Cited

U.S. PATENT DOCUMENTS

| | | | |
|---|---|---|---|
| 2,189,996 | 2/1940 | Riche | 200/67 D |
| 2,573,588 | 10/1951 | Miller | 200/67 D |
| 2,821,588 | 1/1958 | Fisher | 200/67 D |
| 2,971,069 | 2/1961 | Good | 200/67 D |
| 3,210,497 | 10/1965 | Schwartz | 200/67 D |
| 4,050,046 | 9/1977 | Wilson | 200/67 D |

FOREIGN PATENT DOCUMENTS

| | | | |
|---|---|---|---|
| 563471 | 5/1957 | Italy | 200/67 DB |
| 597018 | 3/1978 | U.S.S.R. | 200/67 D |

*Primary Examiner*—Stephen Marcus
*Assistant Examiner*—Renee S. Luebke
*Attorney, Agent, or Firm*—Lilling & Greenspan

[57] ABSTRACT

A microswitch comprises stationary contacts (2,3) mounted on an insulating base (1), a four-link system (5) of levers which is made in the form of a chain including connected to each other in series an actuating link (8), two middle links one of which being a contact link (10) and the other one being an intermediate link (11) and a support link (9), and a limit stop (6) for holding one of the middle links (10 or 11) in the end positions. The actuating link (8) and the support link (9) being the end links are mounted for rocking on the insulating base (1), and one of the middle links, viz. the contact link (10) carries a movable contact alternately interacting with the stationary contacts (2,3). According to the invention, the movable contact (4) is located on the end of the contact link (10) connected with the intermediate link (11), and the limit stop (6) is located close to the place of connection of one of the middle links (10 or 11) with the support link (9).

3 Claims, 24 Drawing Figures

Prior art

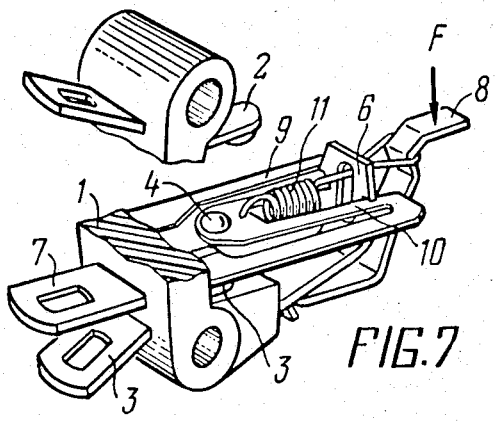
FIG.7
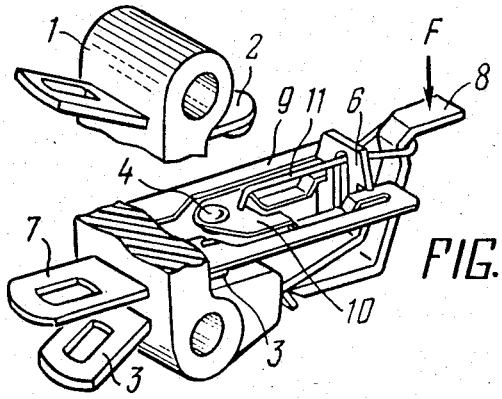
FIG.8
FIG.9
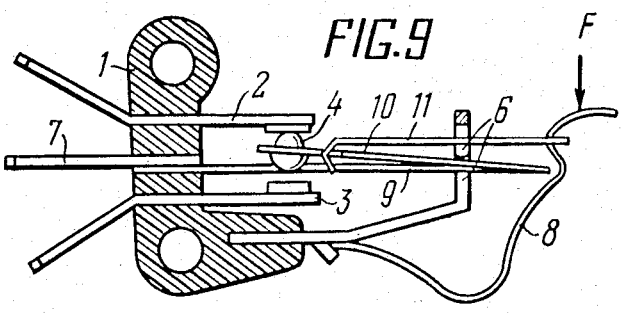

SENSITIVE CONSTANT CONTACT PRESSURE MICROSWITCH

BACKGROUND OF THE INVENTION

1. Field of the Invention

The present invention relates to electrical engineering, and more specifically concerns microswitches.

2. Description of the Prior Art

The accuracy in operation of automatic lines and production control systems depends to a great extent on the sensitivity of microswitches used therein, which microswitches must be accurate in transmission of information. Errors caused by the microswitches during their service are difficult to eliminate practically.

The movable contacts in the microswitches are actuated preferably with the aid of metal plates capable of responding to the changes in temperature or pressure, which plates when being tensed or compressed undergo only a slight bending. Therefore, one of the main characteristics of a microswitch is the sensitivity thereof determined by the length of the movement path of the actuating link (the shorter is the travel path required for operating a movable contact element the higher is the sensitivity of the microswitch), and hence by the quantity of energy required for such microswitches to operate, that is to make or break contacts. An important requirement imposed on microswitches is that they must provide reliable and trouble-free switching under conditions wherein they are exposed to vibrations and shocks even at a low speed of movement of the actuating link. This requirement is determined by the contact resistance which depends on the contact pressure, which contact pressure also determines the resistance of a microswitch to vibration and shocks arising during operation.

U.S. Pat. No. 1,098,074 discloses a microswitch featuring a high sensitivity. This microswitch comprises an insulating base 1' (see FIG. 1), stationary contacts 2', 3' secured on said base 1', a movable contact 4', and a three-link system 5' of levers adapted for selectively changing the position of the movable contact 4'. The three-link system 5' of levers comprises an actuating link 6', an intermediate link 7', and a contact link 8', said links being connected therebetween in series. The actuating link 6' and the contact link 8' are fastened on the insulating base 1' for rocking, with the movable contact 4' fastened on the contact link 8', and one of said links, for instance intermediate link 7' being made elastic.

When the microswitch is in its initial position, the intermediate link 7' which is preliminarily tensed acts on the end of the contact link 8' with a force P. A normal force $P_1$ to produce a contact pressure is $P_1 = P \cdot \sin \alpha$, where $\alpha$ is an angle between the contact link 8' and the intermediate link 7'.

Under the action of an external force F' the actuating link 6' is caused to displace and the intermediate link 7' changes its position relative the contact link 8', in which case the angle $\alpha$ decreases as a result of which the contact pressure $P_1$ respectively decreases. When the actuating link 6' reaches the position of direct operation of the microswitch (that is, when point A reaches line I—I which is a line of unstable initial state of the contact link 8', to take a position $A_1$), the angle $\alpha$ and the contact pressure $P_1$ are equal to "0" (zero).

Shown in FIG. 2 is a contact pressure graph showing a contact pressure variation depending on the movement path of the actuating link 6', where 1 is the path described by a point A of the actuating link 6'.

As the actuating link 6' moves further and the point A intersects the line I—I, the contact 4' is caused to switch over at its natural speed of motion, in which case the actuating link 6' with the point A may reach a position of overtravel (position $A_2$).

When the external force F' does not any more act on the actuating link 6' the latter under the action of the spring moves so that the point A reaches the line II—II, which is a line of an unstable changed position of the contact link 8' (position $A_3$).

Differential travel $L_A$ of the actuating link 6' at the point A is equal to the distance between the points $A_1$, $A_3$, determined from the relationship $$\frac{\Delta L}{L} = \frac{L_A}{H},$$

where H is a contact gap between the contacts 4', 3'; L is a distance from the axis "O" of rotation of the contact link 8' to the axis of the contacts 2', 3', and at the same time is a length of the actuating link 6'; $\Delta L$ is a displacement of the point A from the axis O, which is necessary to provide a snap actuation of the contact 4', and wherefrom $$L_A = \frac{H\Delta L}{L}$$

The differential travel of the actuating link 6' at the point to which the external force F' is applied will be $$L_F = \frac{H\Delta L}{L} \cdot \frac{L_1}{L},$$

where $L_1$ is a length of the actuating link 6' measured from its axis of rotation to the force F' point.

Taking into account small values $$\Delta L/L, \frac{L_1}{L},$$

and H, it is practically possible to obtain a differential motion which is equal $L_F = 0.05$ to 0.001 mm.

As may be seen from the above description of the prior art microswitch operation the time of the direct and reverse switching of the movable contact 4' does not practically depend on the position and speed of movement of the actuating link 6'. However, the contact pressure in such sensitive microswitches changes with the displacement of the actuating link 6' at its speed of motion, from a nominal value to a minimum one, and may even be equal to zero when the actuating link 6' is in a position close to the position in which the microswitch operates (see FIG. 2).

At low speeds of motion of the actuating link 6' of the microswitch a long time during which the contacts are closed, with the contact pressure being insufficient, may cause contact burning, melting, and even their sticking to one another.

In order to provide trouble-free operation of the prior art microswitches the speed of motion of the actuating link 6' of the microswitch must exceed 5 mm/s.

If the speed of motion of the actuating link 6' is lower than 5 mm/s (like in limit switches or pressure and temperature sensors), actuating mechanisms are used to operate movable contacts, which actuating mechanisms comprise a four-link lever system and are adapted to provide a contact operation time and contact pressure which do not practically depend on the position of the actuating link before the microswitch operates, and hence on the speed of movement of said actuating link.

There is known a microswitch disclosed in USSR Inventor's Certificate No. 752,528, (Int. Cl. H 01 H 13/26) which comprises an insulating base 1'' (see FIG. 3). and fastened thereon stationary contacts 2'', 3'', a movable contact 4'', and a four-link lever system 5''. The four-link lever system 5'' is a chain including an actuating link 6'', two middle links 7'', 8'' one of which being an intermediate link and the other one being a contact link, and a support link 9''. The actuating and support links 6'', 9'' are end links and are secured on the insulating base 1'' for rocking, and one of the middle links, namely contact link 8'' carries a movable contact 4'' alternately interacting with the stationary contacts 2'' and 3''. The microswitch also includes a limit stop 10'' fastened on the insulating base and adapted to hold one of the middle links 7'' and 8'' in the end positions in the direction of displacement of the movable contact 4'', and a lead 11'' also secured on the insulating base 1'' and electrically connected with the movable contact 4''.

The intermediate link 7'' is made elastic.

When the microswitch is in its initial position, the preliminarily tensed intermediate link 7'' applies a force P to the end of the contact link 8'' butting against the stop 10''. A force $P_3$ constituting a contact pressure is $P_3=P_2 \sin \beta=P \cos \alpha \sin \beta$, where $\alpha$ is an angle between the contact link 8'' and the intermediate link 7'', $\beta$ is an angle between the contact link 8'' and the support link 9''.

Under the action of the external force F'' the actuating link 6'' is caused to displace, the intermediate link 7'' is tensed and changes its position relative the contact link 8'', in which case the angle $\alpha$ decreases, the angle $\beta$ remains constant and the contact pressure due to the tension of the intermediate link 7'' increases.

When the actuating link 6'' is forced to the position of the direct operation (that is, when the point A reaches the line I—I of the unstable state of the contact link 8'' and takes position $A_1$) the angle $\alpha$ is equal to zero and a contact pressure $P_3'=P_1' \sin \beta$.

Shown in FIG. 4 is a contact pressure graph showing variation of the contact pressure as a result of the actuating link 6'' displacement, where 1 is a path of the point A of the actuating link.

As the actuating link 6'' moves further and the point A intersects the line I—I, the contact 4'' is switched over moving at its natural speed. In this case point A of the actuating link 6'' may reach the position $A_2$.

When the external force F'' is not any more applied to the actuating link 6'' the latter under the action of the return spring moves so that its point A reaches the line II—II which is a line of unstable changed position of the contact link 8'', i.e. it reaches position $A_3$ which is the position of reverse operation of the microswitch.

To ensure switching-over of the contact 4'', the distance between the elements of the stop 10'' restraining the motion of the actuating link 6'' should be somewhat longer than 2H.

In order to simplify calculation let us assume that the gap between the restraining elements in the stop 10'' is 2H. The differential travel of the actuating link 6'' at point A is equal to the distance between points $A_1$ and $A_3$, which distance is determined by the following equation.

$$L_A=H+2\Delta h,$$

where H is a contact gap between the contacts 2'' and 4''.

Since $\Delta BCD''$ is similar to $\Delta O''EA_1$ (FIG. 3) the length of the path $\Delta h$ is determined from the relationship $$\frac{\Delta h}{\Delta L}=\frac{H+\frac{H}{2}}{L},$$

where $\Delta L$ is displacement of point A from the axis O'', which is necessary to provide snap operation of the contact 4'';

L is a distance from the rotation axis O'' of the contact link 8'' to the stop 10'', and at the same time is a length of the actuating link 6''.

The differential travel $L_A$ will be $$L_A=H+3\frac{H\Delta 1}{L}$$

As may be seen from the above description the differential travel of the point A on the actuating link 6'' of the microswitch shown in FIG. 3 consists of two components: a value H equal to 1 to 1.5 mm, and a value $$\frac{3H\Delta 1}{L}$$

which is three times that of the differential travel of the actuating link 6' at point A in the prior art microswitch (FIG. 1), with the same values H, $\Delta L$, L.

Thus, the microswitch shown in FIG. 3 provides reliable switching only at a low speed of motion of the actuating link under condition wherein the switch is exposed to vibration and shocks occurring during operation. However, the sensitivity which is determined by the travel path of the actuating link displacement (differential travel) is not sufficiently high.

SUMMARY OF THE INVENTION

The invention comprises a microswitch in which a movable contact and a limit stop are so arranged that a short differential travel of an actuating link and consequently a high sensitivity of the microswitch as a whole at a constant contact pressure are ensured.

An object of the invention is to eliminate the disadvantages mentioned above.

The object of the invention is achieved by a microswitch comprising stationary contacts secured on an insulating base, a four-link lever system made in the form of a chain including an actuating link, two middle links one of which is a contact link and the other one is an intermediate link, a support link, the actuating and support links being the end links are mounted for rocking on the insulating base, and one of the middle links which is a contact link carries a movable contact alternately interacting with the stationary contacts, and a limit stop intended for holding one of the middle links in the end positions in the direction of the movable contact displacement and secured on the insulating base, according to the invention the movable contact is located on the end of the contact link connected with the intermediate link, and the limit stop is located close to the place of connection between the middle link and the support link.

Such arrangement of the limit stop and the movable contact allows the actuating link of the lever system to have a short differential travel and to thereby improve the sensitivity and mechanical wear resistance of the microswitch, and also to ensure a constant contact pressure at low (creeping) speeds of movement of the actuating link before it reaches the position of operation.

In the case one of the middle links is subjected to a tension stress it is expedient that the limit stop be located between the movable contact and the place of contact link with the support link. This will not allow the contact pressure to decrease to zero when the actuating link is moving to the position wherein the switch operates.

In the case one of the middle links is subjected to a compression stress it is expedient that the contact link have on its end connected with the support link a projecting portion, and the limit stop interact with this projecting portion, of the contact link.

A modification of the proposed microswitch is possible wherein both middle links and the support link are made integral in the form of a flat spring, which allows the size of the microswitch to be decreased and the construction thereof to be simplified.

A modification of the proposed microswitch is also possible wherein in order to simplify the construction of the microswitch and decrease its size all the links of the lever system are made integral in the form of a flat spring.

BRIEF DESCRIPTION OF THE DRAWINGS

The invention will now be explained in greater detail with reference to the accompanying drawings, wherein:

FIG. 7 is an axonometric view of the microswitch of the invention, wherein the intermediate link serves as an elastic element;

FIG. 8 is an axonometric view of the microswitch of the invention, wherein the contact link serves as an elastic element of the lever system;

FIG. 9 is a longitudinal section of the microswitch of the invention, wherein the actuating link is an elastic element of the lever system;

DESCRIPTION OF THE PREFERRED EMBODIMENTS

Figure 1:
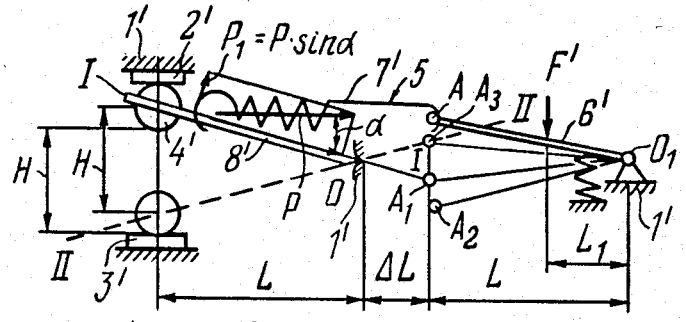
FIG. 1 shows a kinematic diagram of the prior art microswitch having a three-link lever system.
Figure 2:
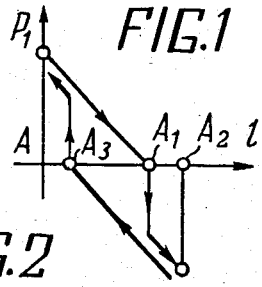
FIG. 2 is a contact pressure graph showing variation of the contact pressure in the microswitch of FIG. 1, depending on the actuating link displacement.
Figure 4:
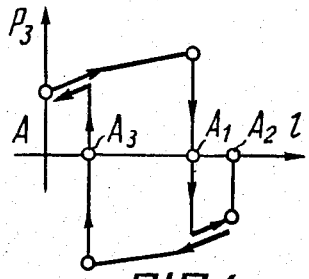
FIG. 4 is a contact pressure graph showing variation of the contact pressure in the microswitch of FIG. 3, depending on the actuating link displacement.

A microswitch comprises stationary contacts 2, 3 fastened on an insulating base 1 (see FIG. 5), a movable contact 4, a four-link system 5 of levers adapted for selectively switching the movable contact to its end positions, and a limit stop 6 secured on the insulating base 1.

A three-pole microswitch also includes a current lead 7 fastened on the insulating base 1 and electrically connected with the movable contact 4.

The four-link system 5 of levers includes two end links 8, 9 which are an actuating link and a support link respectively, and two middle links 10, 11 which are a contact link and an intermediate link respectively, with at least one of the links being a spring link. Each of the links may be a spring link, that is either the intermediate link 11 (FIG. 7), or the contact link 10 (FIG. 8), or the actuating link 8 (FIG. 9).

One end of each of the end links 8, 9 is connected in any conventional manner (for instance, hinged) to the insulating base 1 for rocking, and each of the middle links 10, 11 has its one end connected to one end of the other middle link and its other end connected to one of the end links 8, 9.

The middle link connected to the actuating link 8 may work either in tension or in compression.

In the case all the links 8, 9, 10 and 11 of the leverage 5 are made as separate members they are connected to each other in a conventional way with the aid of fastening elements.

The movable contact 4 of the microswitch is fastened on the contact link 10.

According to the invention the movable contact 4 is disposed on the end of the contact link 10 connected with the intermediate link 11, and the limit stop 6 for holding one of the middle links 10 or 11 in the end positions in the direction of the movable contact 4 displacement is located close to the place of connection of the middle link 10 or 11 with the support link 9.

Such arrangement makes it possible to decrease the differential travel of the actuating link 8 and thereby improve the sensitivity of the microswitch and the mechanical wear resistance thereof, and also ensure a constant contact pressure at low (creeping) speeds of movement of the actuating link 8 before it reaches the position in which the microswitch operates.

It is expedient that in the microswitch wherein one of the middle links 10 or 11 works in tension, the limit stop 6 be disposed between a movable contact 4 (see FIGS. 7–9, 14) located on the contact link 10 and the place of connection of the contact link 10 with the support link 9. Such arrangement will not allow the contact pressure to decrease to zero when the actuating link is moving to the operating position.

A modification of the proposed microswitch is possible wherein the limit stop 6 is disposed so as to limit the movement of the intermediate link 11 in the central portion thereof.

It is expedient that in the microswitch wherein one of the middle links works in compression, the contact link 10 (see FIGS. 10–13, 15–21) have on its end connected with the support link 9 a projection or end 12, and the limit stop 6 interact with the end 12 of the contact link 10.

It is clear that the end 12 may be provided on the intermediate link 11, in which case the limit stop 6 limits the motion of the intermediate link 11, interacting with the end 12 thereof.

In order to reduce the size of the microswitch and simplify its construction both middle links 10 and 11 and the support link 9 are made integral in the form of a flat spring (FIGS. 10–13). In this and the following modifications of the proposed microswitch the place of connection between the middle link and the support link close to which is located the limit stop 6 is a transition of one link into another.

Figure 14:
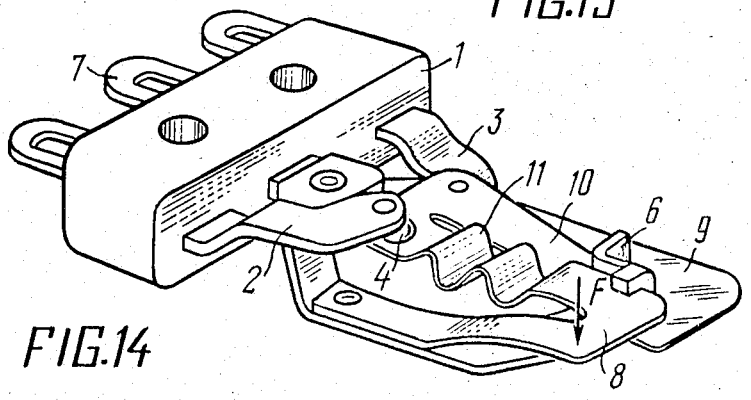
FIG. 14 is a modification of the proposed microswitch, wherein all the links of the system of levers are made integral in the form of a flat tension spring, axonometric view.
Figure 15:
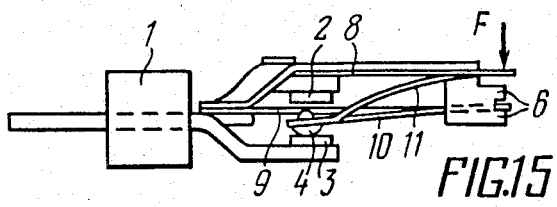
FIG. 15 shows the same as in FIG. 14, but is provided with a compression spring.
Figure 16:
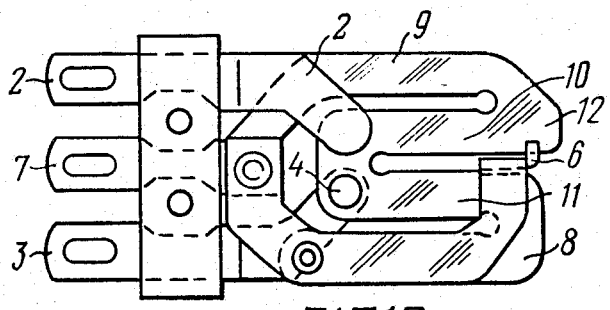
FIG. 16 is the same as in FIG. 15, top view.
Figure 17:
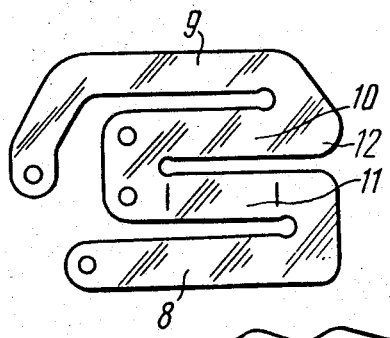
FIG. 17 shows the first spring of the microswitch of FIGS. 15 and 16.
Figure 18:
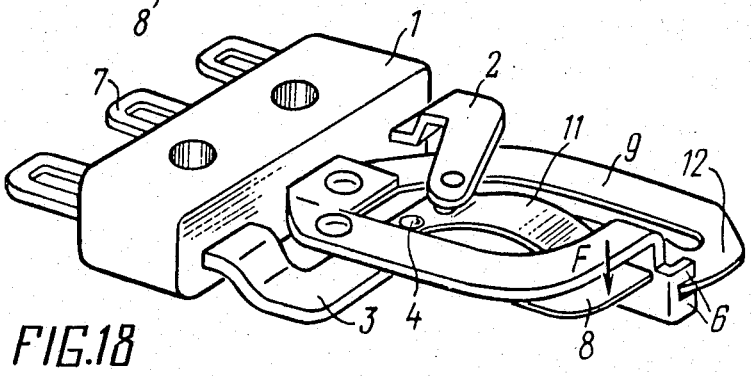
FIG. 18 is an axonometric view of the microswitch of FIG. 15.
Figure 19:
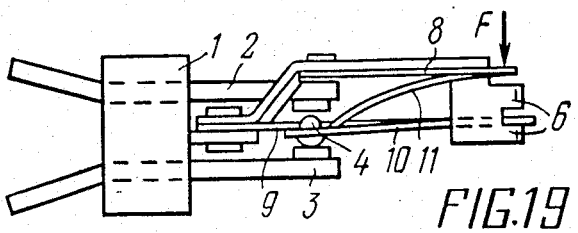
FIG. 19 is a general view of the modification of the microswitch shown in FIG. 15, except for that the microswitch is of a four-pole type.
Figure 20:
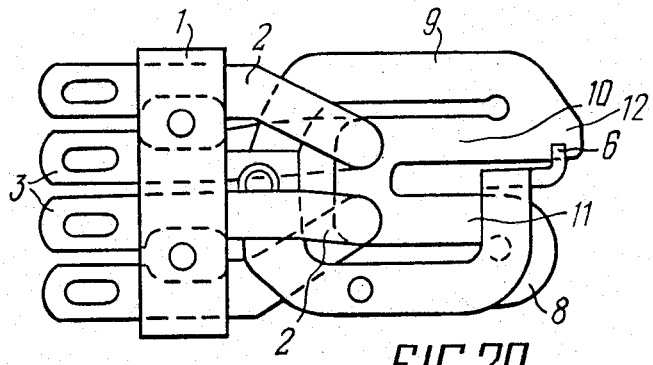
FIG. 20 is a top view of the microswitch of FIG. 19.
Figure 21:
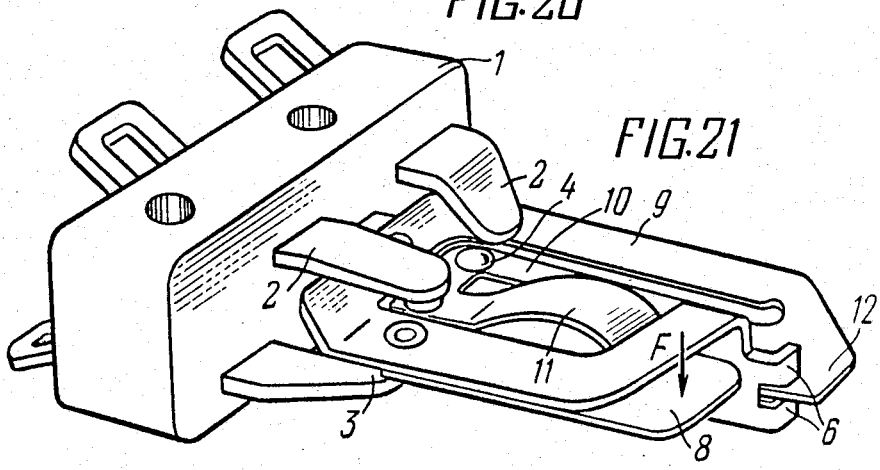
FIG. 21 is an axonometric view of the microswitch of FIG. 19.

The size of the microswitch may be decreased and the construction thereof may be simplified since all the links 8, 10, 11 and 9, or 8, 11, 10 and 9 are made integral in the form of a flat spring (see FIGS. 14–16).

The microswitch of the invention operates in the following manner.

Figure 5:
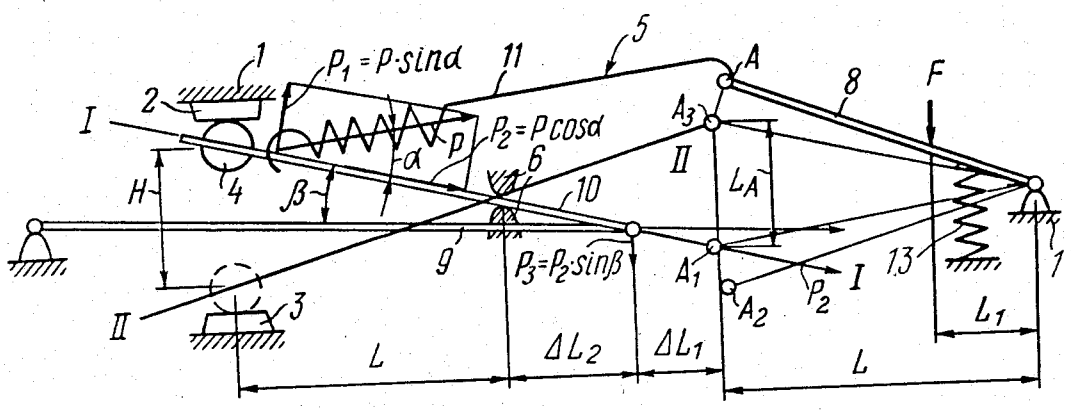
FIGS. 5–6 show a kinematic diagram of the microswitch according to the invention.
Figure 6:
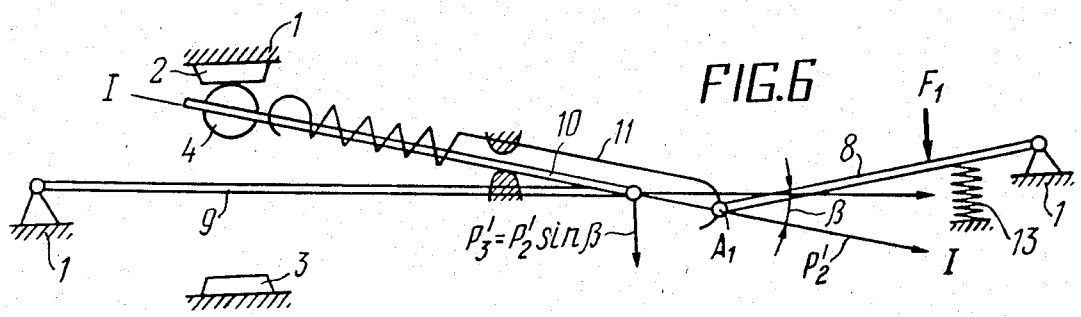
Figure 10:
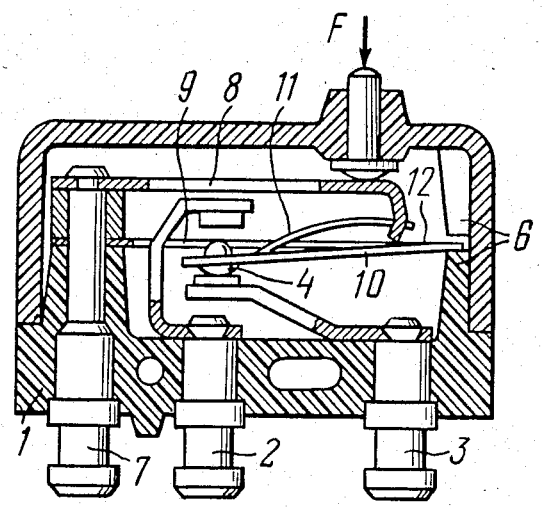
FIG. 10 illustrates a microswitch of the invention, wherein two middle links and the support link are made integral in the form of a flat spring, general view (longitudinal section)
Figure 11:
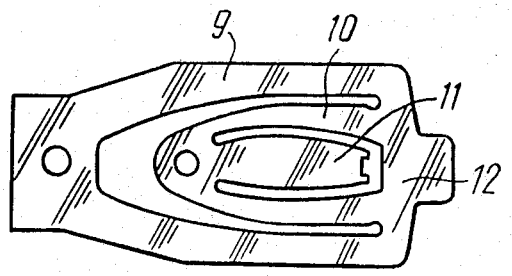
FIG. 11 shows the flat spring in FIG. 10.
Figure 12:
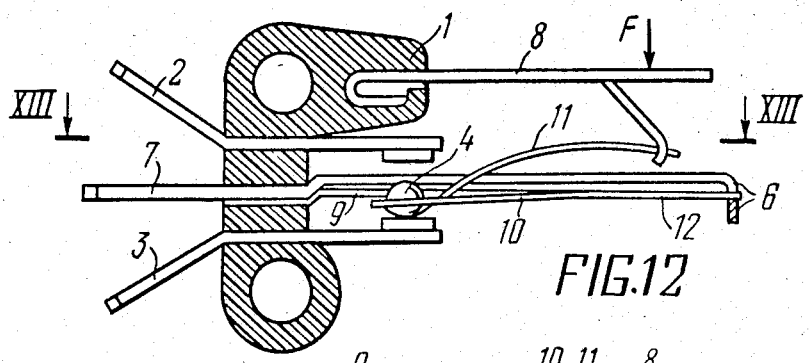
FIG. 12 shows a modification of FIG. 10; wherein the flat spring has a different shape.
Figure 13:
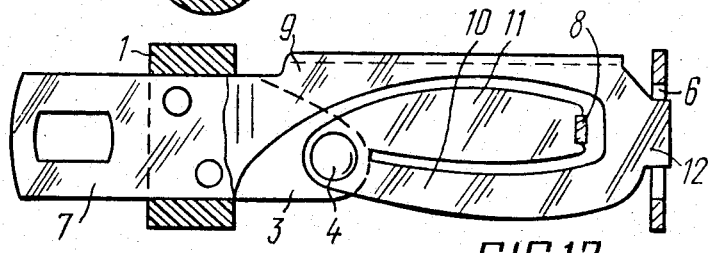
FIG. 13 is a section along line XIII—XIII in FIG. 12.

When the microswitch is in its initial position the intermediate link 11 which is preliminarily tensed exerts a force P on the end of the contact link 10 (FIGS. 5–6).

The contact pressure thus produced consists of two components:

$$Pk = P_1 + P_3 \frac{\Delta L_2}{L}$$

where $P_1 = P \sin \alpha$ and $P_3 = P_2 \sin \beta$ where $\alpha$ is an angle between the contact link 10 and the intermediate link 11;

$\beta$ is an angle between the contact link 10 and the support link 9;

$\Delta L_2$ is a distance from the point of connection between the contact link 10 and the support link 9 to the point of contact of the contact link 10 with the limit stop 6;

$P_1$, $P_2$ are the components of the force P, exerted by the intermediate link 11;

$P_3$ is a normal component of the force $P_2$;

L is a length of the contact link 10.

Under the action of an external force F the actuating link 8 displaces, and the intermediate link 11 is caused to change its position relative the contact link 10.

In this case the angle $\alpha$ decreases, and the angle $\beta$ remains constant.

At the moment the actuating link 8 reaches the position of the direct operation of the microswitch (when the point A reaches the line I—I which is the line of unstable state of the contact link 10, and takes the position A) the angle $\alpha$ will be zero and the contact pressure will be nominal.

Figure 22:
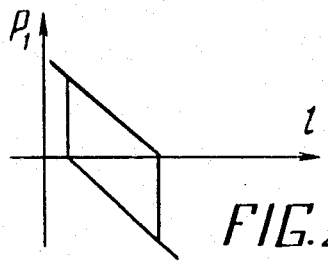
FIGS. 22–24 represent a contact pressure graph showing variation of the contact pressure in the microswitch of the invention, depending on the actuating link displacement.
Figure 23:
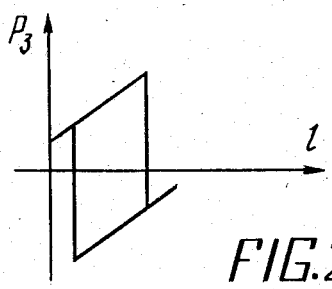
Figure 24:
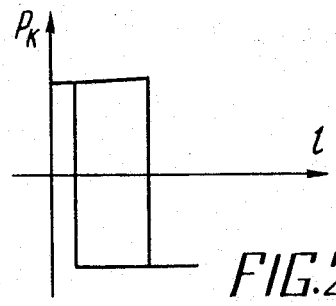

Shown in FIGS. 22–24 is a contact pressure graph showing variation of the contact pressure depending on the movement of the actuating link 8.

As is evident from the graph (FIGS. 22–24) the contact pressure in the microswitch may be maintained constant while the actuating link 8 is moving to the operating position, by selecting a spring force and angles $\alpha$ and $\beta$.

As the actuating link 8 moves further and the point A intersects the line I—I the contact 4 is caused to change over moving at its natural speed, and the point A on the actuating link 8 may reach the overtravel position (position $A_2$).

When the external force is not any more applied to the actuating link 8 the latter under the action of the spring intermediate link 11 is urged to return back in its initial position.

At the moment the point A on the actuating link intersects the line II—II which is the line of unstable state of the contact link 10, that is when the point A reaches the position $A_3$ the movable contact 4 is caused to change over.

The differential travel of the actuating link 8 designated as $L_A$ at the point A is equal to the path $A_1A_3$ and is determined from the relationship $$\frac{H}{L} = \frac{L_A}{\Delta L_2 + \Delta L_1} \text{ wherefrom}$$

$$L_A = \frac{H(\Delta L_2 + \Delta L_1)}{L}$$

Taking into consideration that the value $$\frac{\Delta L_2 + \Delta L_1}{L}$$

is small, the differential travel of the point A is $L_A = (0.02 \text{ to } 0.05)\ H$ mm.

Figure 3:
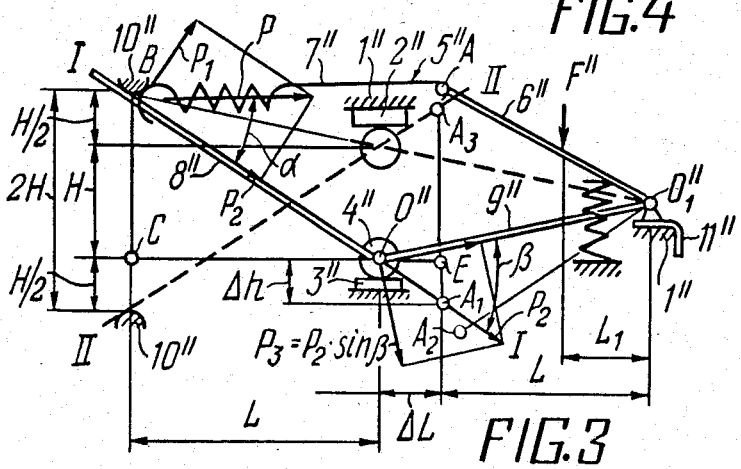
FIG. 3 shows a kinematic diagram of another prior art microswitch having a four-link lever system.

As may be seen from the above description, the differential travel of the actuating link 8 of the proposed microswitch is hundreds of times less than the differential travel of the actuating link 6'' in the prior art microswitch (FIG. 3).

It may be readily understood that in the case of a preliminarily compressed intermediate link the microswitch operates in a similar manner.

While the invention has been described herein in terms of the preferred embodiments various modifications may be made in the invention without departing from the spirit and the scope of the appended claims.

The invention can be used to advantage in automatic lines and control and protection signalling systems in electric drives of hoisting and conveying means, machine tools and other production equipment, as limit switches which are used either for connecting or disconnecting electromagnetic devices or for providing information on current positions of mechanisms and machines, pressure, temperature and other values to be controlled.

What is claimed is:

1. A microswitch comprising an insulating base; stationary contacts secured on said insulating base; a four-link system of levers which includes a plurality of links connected in series with each other including an actuating link, two middle links one of which is a contact link and the other of which is an intermediate link, a support link, said actuating link and said support link being mounted for rocking on said insulating base; a movable contact on one of said middle links which serves as said contact link for alternately interacting with said stationary contacts; and limit stop means for holding one of said middle links in the end positions in the direction of said movable contacts, said movable contact being disposed on the end of said contact link connected with said intermediate link, and said limit stop means being mounted close to the place of connection of one of said middle links with said support link, whereby the microswitch exhibits high sensitivity and constant contact pressure, and being further characterized in that said limit stop means is located between said movable contact and the place of connection of said contact link with said support link.

2. A microswitch according to claim 1, characterized in that both said middle links and said support link are made integral in the form of a flat spring.

3. A microswitch according to claim 1, characterized in that all said links are made integral in the form of a flat spring.

* * * * *